United States Patent [19]

Egnew

[11] 4,369,000

[45] Jan. 18, 1983

[54] RELEASABLE JOINT CONNECTOR

[76] Inventor: J. C. Egnew, P.O. Box 425, Sterns, Ky. 42647

[21] Appl. No.: 216,955

[22] Filed: Dec. 16, 1980

[51] Int. Cl.[3] ..... B25G 3/00; F16D 1/00; F16G 11/00

[52] U.S. Cl. ..... 403/406; 403/170; 403/220

[58] Field of Search ..... 403/220, 170, 171, 172, 403/176, 405, 406; 135/3 E, 4 R; 16/225; 3/1.9, 1.91

[56] References Cited

U.S. PATENT DOCUMENTS

| | | | |
|---|---|---|---|
| 2,440,557 | 4/1948 | Power . | |
| 3,457,930 | 7/1969 | Gladden et al. . | |
| 3,514,989 | 6/1970 | Robinson | 16/225 X |
| 3,532,369 | 10/1970 | Reilly . | |
| 3,616,487 | 11/1971 | Dearth | 16/225 |
| 3,711,133 | 1/1973 | Werner | 403/220 X |
| 4,068,889 | 1/1978 | Pierce et al. | 16/225 X |
| 4,076,432 | 2/1978 | Glaser . | |
| 4,204,284 | 5/1980 | Koeneman | 3/1.91 |
| 4,236,274 | 12/1980 | Omote et al. | 16/225 |
| 4,239,156 | 12/1980 | Skinner et al. | 16/225 |

FOREIGN PATENT DOCUMENTS

| | | | |
|---|---|---|---|
| 1401394 | 4/1965 | France | 16/225 |
| 434883 | 10/1937 | Switzerland | 403/220 |
| 613741 | 10/1979 | Switzerland | 135/3 R |
| 413490 | 7/1934 | United Kingdom | 403/220 |

*Primary Examiner*—Wayne L. Shedd

*Attorney, Agent, or Firm*—Luedeka, Fitch & Neely

[57] ABSTRACT

An integrally formed releasable joint connector has a central bridge member with two bosses flexibly connected to the central bridge member and projecting in opposite directions from the opposite ends of the central bridge member. The two bosses are each generally cylindrical with an H-shaped transverse cross-section and are adapted to be received in and frictionally grip hollow structural members, such as tent poles, hollow frame members of a display counter, and the like.

17 Claims, 9 Drawing Figures

RELEASABLE JOINT CONNECTOR

The present invention relates to releasable joint connectors for coupling hollow structural members.

Hollow structural members have a variety of applications. For example, hollow structural members have wide spread use as tent frames particularly external tent frames.

Two types of external tent frames used generally for cabin tents are the yoke style and the ridge style.

In the yoke style external tent frame, the main supporting frame members which contact the ground extend up and over the tent generally transversely of the ridge of the tent roof. One main support frame member is usually located at the front of the tent and another main support frame member is usually located at the rear of the tent. A ridge pole is connected at its opposite ends to the main support frame members at the front and rear of the tent. The tent canopy is connected to the main support frame members and ridge pole by means of straps.

The ridge style external tent frame is similar in construction to the yoke style tent frame. However, in the ridge style frame the main supporting frame members which contact the ground usually extend up and over the tent generally parallel to the ridge of the tent roof. The tent canopy is connected to the main supporting frame members by means of straps.

External tent support frame members are typically fabricated of straight lengths of hollow tubes and elbow members of hollow tubing. These hollow tubes and elbow members are usually made of aluminum or plated steel. The external tent frame is assembled by inserting the free ends of the elbow members into the ends of the straight lengths of hollow tubes.

Tents, of course, come in many different sizes and the external frame structure must be sized accordingly. The sizing of the straight lengths of tubing does not present a great problem in the manufacture of tent support frames. For example, these straight lengths of tubing can be fabricated of telescoping components so that the overall length can be changed to suit various sized tents. Alternatively, the frame manufacturer can readily make straight tubes of various lengths for each size tent by simply cutting the straight tubes to the desired length. Therefore, only one piece of manufacturing equipment is need be used to fabricate straight tubes of different lengths.

The problem in manufacturing tent support frames of different sizes is in manufacturing of the elbow members. Tent frames of different sizes use elbow members with different degrees of bend. A different bending die or fixture is required to manufacture each elbow of a different degree of bend. This leads to a proliferation of tooling which is, of course, expensive. In addition to the cost of tooling itself, an additional expensive is incurred in man hours required to change the tooling and manufacturing down time while changing from a die or fixture to produce one size elbow to a die or fixture to produce another size elbow. Additionally the elbow sections require more storage space, thus enlarging the overall size of the tent carton.

As previously mentioned, the tent canopy is usually attached to the elbow members of the tent frame by means of straps. In some cases these straps encompass the elbow, however, the straps have a tendency to slip along the curve of the elbow in which case the tent canopy is not held taut. In other cases attachment rings are connected to the elbow member and the strap tied to the attachment ring. While this solves the problem of the strap slipping along the elbow member, the use of an attachment ring adds to the cost of manufacture of the tent support frame.

Typically in yoke-type external tent frames, a strap is used to connect the ridge pole to the main supporting members. A strap encompasses the central elbow member of each of the main support frame members. This strap has a grommeted hole which receives an end of the ridge pole. Another, usually elastic strap is connected to the tent canopy and this elastic strap is placed around the end of the ridge pole extending through the grommeted hole of the strap attached to the central elbow member of the tent frame. These various straps, and grommets required to reinforce the straps, add to the cost of manufacture of tents and are potential weak points in the tent construction for after prolonged use, they tend to rip.

Hollow structural members, such as hollow tubing, also have use in, for example, display counter frames and the like.

Display counter frames share many problems with tent frames. For example, display counters obviously must be of various sizes to suit different space requirements and limitations. The sizing of the straight frame members does not present a significant problem to a manufacturer of counter frames.

Straight frame members of different lengths can readily be fabricated by simply cutting the straight frame members to the desired length on, for example, a band saw. Therefore, only one piece of manufacturing equipment, the saw, need be used. The problem in manufacturing counter frames of different sizes is in the manufacture of the elbow or corner joints. Counter frames of different sizes often require elbow or corner joints of different sizes and different degrees of bend. A different bending die or fixture is required to manufacture each elbow or joint connector of a different degree of bend. This leads to a proliferation of tooling which is expensive. In addition to the cost of tooling itself, an additional expense is incurred in man hours required to change the tooling and manufacturing down time while changing from a die or fixture to produce one size elbow to a die to produce another size elbow.

Another concern is that the elbow or corner joint connectors be firmly attached to the straight structural frame members to produce a sturdy display counter frame.

A further concern with display counter frames is that they be rigid so that items resting thereon will not be easily knocked over if the display counter is jarred.

An object of the present invention is to provide a releasable elbow or corner joint connector which can be used for coupling structural frame members to produce frames of various sizes.

Another object of the present invention is to provide an elbow or corner joint connector for coupling structural frame members without the use of tools.

Yet another object of the present invention is to provide an elbow or corner joint connector which firmly couples structural frame members without the use of fasteners.

Still another object of the present invention is to provide a rigid elbow or corner joint connector for coupling structural frame members.

A further object of the present invention is to provide an elbow or corner joint connector particularly well suited for external tent frames which eliminates the need for tent straps with grommeted holes for supporting the tent canopy.

Still a further object of the present invention is to provide an elbow or corner joint connector particularly well suited for external tent frames which does not require attaching rings for holding a tent strap securely in place thereon.

Yet a further object is to reduce overall size of storage and/or carrying cartons for the tent components.

Other objects and advantages of the invention will become known by reference to the following description and drawings in which.

Figure 1:
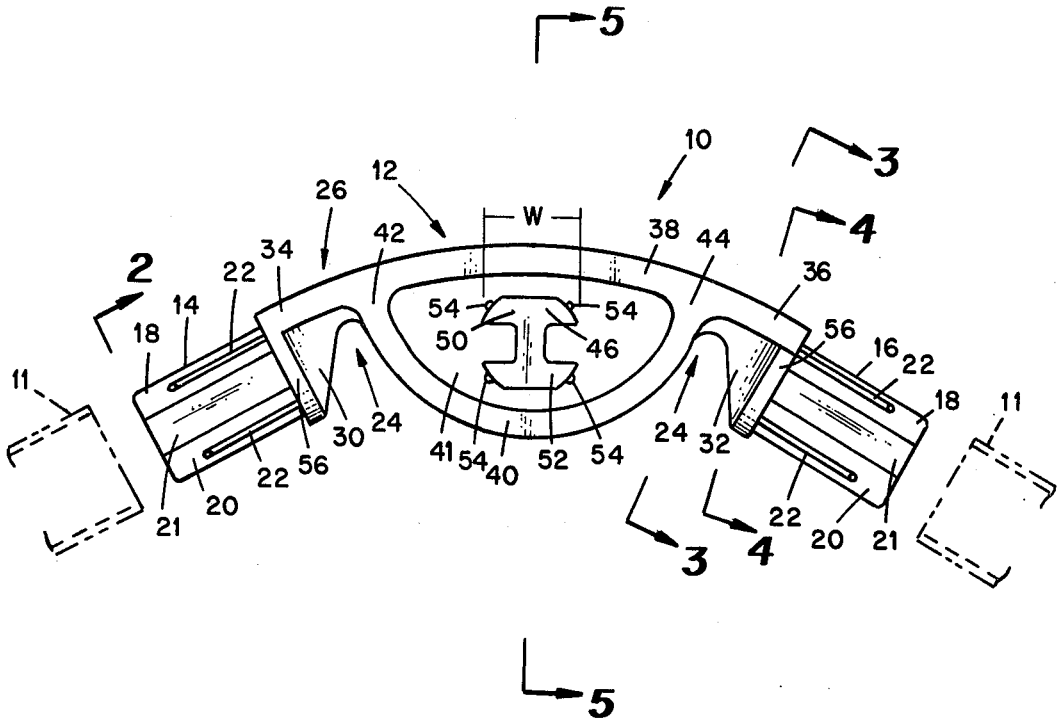
FIG. 1 is a side view of one embodiment of a corner joint connector.
Figure 2:
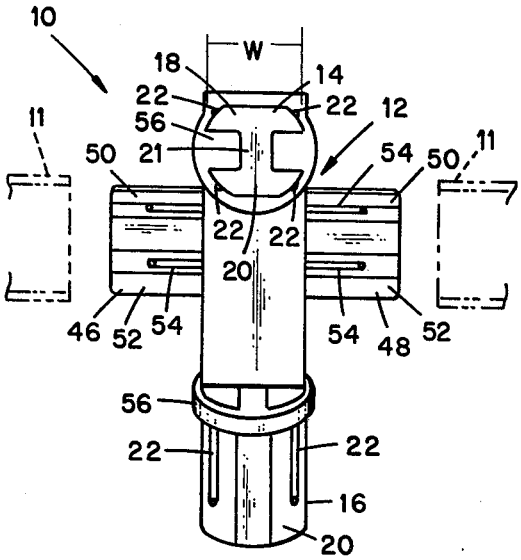
FIG. 2 is an end view taken in the direction of arrows 2—2 in FIG. 1.
Figure 6:
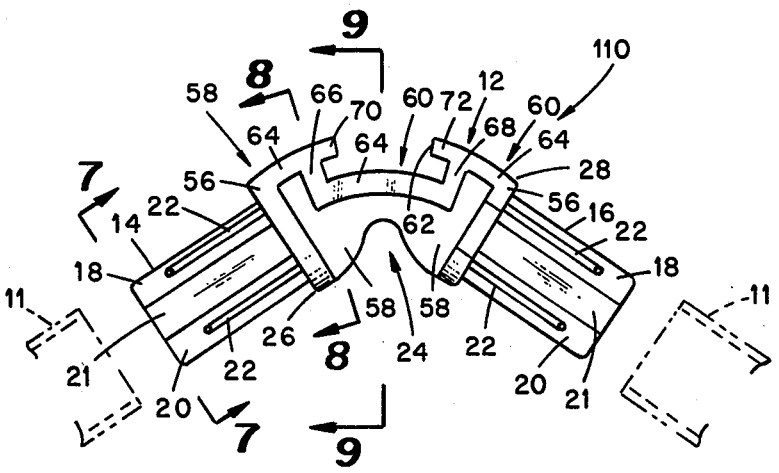
FIG. 6 is a side view of another embodiment of a corner joint connector.
Figure 7:
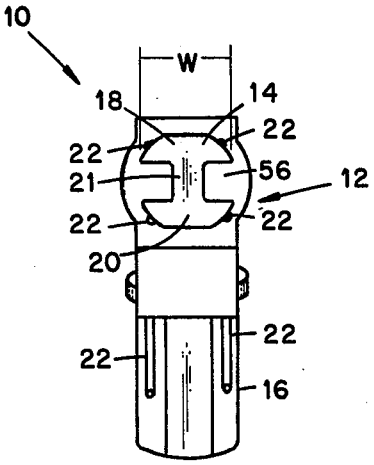
FIG. 7 is an end view taken in the direction of arrows 7—7 in FIG. 6.

FIGS. 1 and 2, shown one embodiment of an integrally formed releasable elbow or corner joint connector, generally denoted as the numeral 10 and FIGS. 6 and 7 show another embodiment generally denoted as the numeral 110, for coupling hollow structural members 11. The corner joint connector 10 and 110 is molded or cast of a synthetic thermoplastic material such as, for example, polypropylene, polystyrene, polyvinylidene choloride or polyvinylidene floride. The structural members 11 could be tent poles or structural frame members of a display counter or the like.

In the following discussion, for the sake of clarity, identical portions of each embodiment will be referred to by identical numerals.

The joint connector 10 and 110 includes a central bridge member 12 with a first boss 14 connected to and extending from a first end of the central bridge member 12 and a second boss 16 connected to and extending from a second end of the central bridge member 12. The first and second bosses 14 and 16 are adapted to be longitudinally received in one end of a hollow structural member 11 with a press fit relationship.

As can be best seen in FIGS. 1, 2, 6 and 7, the first boss 14 and second boss 16 are generally cylindrical with a generally H-shaped transverse cross-section. The H-shaped transverse cross-section is defined by two generally parallel flanges 18 and 20 which are the same width "W" and a center web 21. The width "W" of the flanges 18 and 20 is wider than the cord length of the hollow structural member 11 which receives the bosses 14 and 16 at the locations of contact of the flanges 18 and 20 with the interior wall surface of the hollow structural member 11. Thus, when the bosses 14 and 16 are received in a hollow structural member 11, the flanges 18 and 20 will be resiliently deflected by the hollow structural member 11 providing a press fit relationship between the boss and the hollow structural member.

With continued reference to FIGS. 1, 2, 6 and 7, each boss 14 and 16 is also formed with a plurality of longitudinally extending mutually parallel splines 22. The splines 22 protrude outwardly from the bosses 14 and 16. As can be best seen in FIGS. 2 and 7, the splines 22 are disposed in pairs wherein the splines 22 of a pair are diametrically opposed around the periphery of the boss from each other. As illustrated the outside distance between the splines 22 of a pair of splines is greater than the centerline distance across the transverse cross-section of the hollow structural member 11 into which the boss is received. The splines 22 frictionally grip the interior wall surface of the hollow structural member 11.

Figure 3:
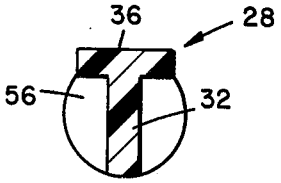
FIG. 3 is a transverse cross-sectional view taken in the direction of arrows 3—3 in FIG. 1.
Figure 4:
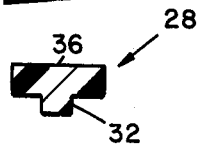
FIG. 4 is a transverse cross-sectional view taken in the direction of arrows 4—4 in FIG. 1.

Now with reference to FIGS. 1, 3 and 4, the central bridge member 12 of the joint connector 10 includes at least one area of reduced cross-section, denoted as the number 24, to provide the first boss 14 and second boss 16 with a degree of resilient flexibility in one plane of the central bridge member 12. In this illustrated embodiment, the central bridge member 12 is formed with two such areas of reduced cross-section 24. The first area of reduced cross-section is near the interface between the first boss 14 and the central bridge member 12, and the second area of reduced cross-section is near the interface between the second boss 16 and the central bridge member 12.

FIGS. 1, 3 and 4 show the first end of the central bridge member 12, generally denoted as the numeral 26, from which the first boss 14 extends, formed with a generally T-shaped transverse cross-section and the second end of the central bridge member 12, generally denoted as the numeral 28, from which the second boss 16 extends, formed with a generally T-shaped transverse cross-section. The stem 30 of the T-shaped first end 26 tapers from a maximum depth near the first boss 14 to a reduced depth generally inwardly of the central bridge member 12 from the first boss 14 to provide the first area of reduced cross-section 24. Similarly, the stem 32 of the T-shaped second end tapers from a maximum depth near the second boss 16 to a reduced depth generally inwardly of the central web member 12 from the second boss 16 to provide the second area of reduced cross-section 24.

Figure 5:
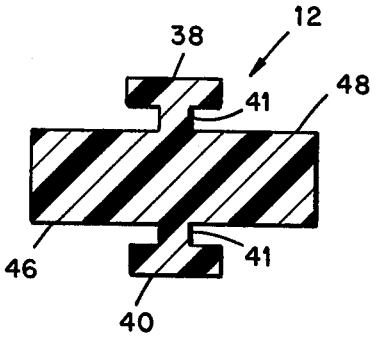
FIG. 5 is a transverse cross-sectional view taken in the direction of arrows 5—5 in FIG. 1.

Referring to FIGS. 1 and 5, the portion of the central bridge member 12 between the two areas 24 of reduced cross-section has generally an I-shaped transverse cross-section. The I-shaped transverse cross-section is defined by a top flange 38, a bottom flange 40 and a web 41 extending between and perpendicular to the top and bottom flanges. The I-shaped cross-section gives the central bridge member 12 the attributes of an I-beam, that is, lightness of weight without sacrificing rigidity.

As can be best seen in FIG. 1, the cross flange 34 of the T-shaped cross-section of the first end 26 and the cross flange 36 of the T-shaped cross-section of the second end 28 are both coextensive or continuous with the top flange 38 of the I-shaped cross-section of the central bridge member 12. The bottom flange 40 of the I-shaped cross-section of the central bridge member 12 is illustrated as being longitudinally arcuately formed and joins the top flange 38 of the I-shaped cross-section of the central web member 12 at its opposite ends 42 and 44 near the first and second areas of reduced cross-section 24, respectively.

Now referring to FIGS. 1, 2 and 5, the illustrated embodiment has a third boss 46 and a fourth boss 48. The third boss 46 and fourth boss 48 extend coaxially outwardly from opposite sides of the center web 41 of the I-shaped cross-section of the central bridge member 12 intermediate the first boss 14 and second boss 16. The third and fourth bosses 46 and 48 are each generally cylindrical with a generally H-shaped transverse cross-section. The H-shaped transverse cross-section is defined by two generally parallel flanges 50 and 52 which are the same width "W". The width "W" of flanges 50 and 52 is wider than the cord length of the hollow structural member 11 which receives the bosses 46 and 48 at the locations of contact of the flanges 50 and 52 with the interior wall surface of the hollow structural member 11. Thus, when the bosses 46 and 48 are received in a hollow structural member 11, the flanges 50 and 52 will be resiliently deflected by the hollow structural member 11 providing a press fit relationship between the boss and the hollow structural member 11.

With continued reference to FIGS. 1 and 3, each boss 46 and 48 is also formed with a plurality of longitudinally extending mutually parallel splines 54. The splines 54 protude outwardly from the bosses 46 and 48. As can be best seen in FIG. 1, the splines 54 are disposed in pairs wherein the splines 54 of a pair are diametrically opposed around the periphery of the boss from each other. As illustrated the outside distance between the splines 54 of a pair of splines is greater than the centerline distance across the transverse cross-section of the hollow structural member into which the boss is received. The splines 54 frictionally grip the interior wall surface of the hollow structural member 11.

With reference to FIGS. 1, 2, 3, 6, 7 and 8, the joint connector 10 and 110 also includes stop means such as, for example, an abutment 56 at the interface of the first boss 14 with first end 26, and the interface of the second boss 16 with second end 28 of the central bridge member 12. The abutments 56 extend radially outwardly of the bosses and serves as a stop to the hollow structural member 11 so that the boss can not be inserted too far into the hollow structural member.

Now with reference to FIGS. 6 through 9 the central bridge member 12 of the joint connector 110 is formed with one area of reduced cross-section 24 intermediately disposed between the first boss 14 and second boss 16 to provide the bosses with a degree of resilient flexibility in one plane of the central bridge member 12.

Figure 8:
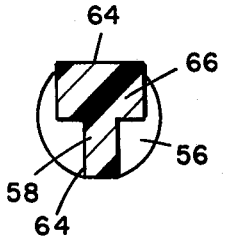
FIG. 8 is a transverse cross-sectional view taken in the direction of arrows 8—8 in FIG. 6; and, FIG. 9 is a transverse cross-sectional view taken in the direction of arrows 9—9 in FIG. 6.
Figure 9:
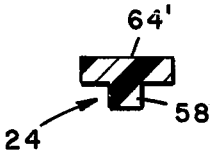

With reference to FIGS. 6, 8 and 9, the central bridge member 12 is formed with a generally T-shaped transverse cross-section. The stem 58 of the T-shaped central bridge member 12 tapers from a maximum depth near each boss 14 and 16 to a reduced depth inwardly of the central bridge member 12 to provide the area of reduced cross-section 24.

Now with reference to FIG. 6, the central bridge member 12 is formed with an elongated slot, generally denoted as the numeral 60 between the first boss 14 and second boss 16. As illustrated, the slot 60 is centrally located over the area of reduced cross-section 24. The elongated slot 60 is open at 62 and extends to either side of the opening 62 toward the first boss 14 and second boss 16 so that the slot 60 is wider than the opening 62.

As illustrated in FIG. 6, the slot 60 and opening 62 are defined by the cross-flange 64 of the T-shaped central bridge member 12. The cross-flange 64 includes two spaced apart jogged areas 66 and 68 and two cantilevered extensions 70 and 72 projecting toward each other from the jogged areas 66 and 68, respectively. The slot 60 is defined between the cantilevered extensions 66 and 68 and the underlying cross-flange 64, and the opening 62 is defined between the free ends of the two cantilevered extensions 70 and 72.

The illustrated embodiments of FIGS. 1 through 5 and 6 through 9 are advantageous integrally formed as by molding or casting of, for example, a plastic material such as polypropylene, polystyrene, polyvinylidene chloride and polyvinylidene floride for strength and lightness.

The embodiment of FIGS. 1 through 5 is well adapted for use as a counter frame corner joint connector, or as a tent frame corner joint connector. The areas of reduced cross-section 24 allow for resiliently flexibility of the bosses 14 and 16 relative to the central bridge member 12 and, thus, allows the included angle between the first boss 14 and second boss 16 to be altered to suit frames of different sizes.

The embodiment of FIGS. 6 through 9 is also well suited for use as a counter frame corner joint connector, or as a tent frame corner joint connector. The area of reduced cross-section 24 allows for resilient flexibility of the bosses 14 and 16 allowing the included angle between the first boss 14 and second boss 16 to be altered to suit frames of different sizes. The slot 60 provides the corner joint connector with utility for tent frames in that a tent canopy support strap is insertable into the slot 60 through the opening 62 and is securely held fast in the slot against inadvertent removal because the slot 60 is wider than the opening 62 thus capturing the strap in the slow 60 to either side of the opening 62.

The H-shaped configuration of the bosses 14, 16, 46 and 48 provide a tight yet releasable press fit between the corner joint connector and hollow structural member 11. The longitudinal splines 22 on the bosses 14, 16, 46 and 48 provides a friction grip between the bosses and the hollow structural members 11 to assure a secure connection.

The I-shaped transverse cross-section of the central bridge member 12 has the characteristics of an I-beam. That is, this configuration makes the central web member rigid but light in weight.

The foregoing detailed description is given primarily for clearness of understanding and no unnecessary limitations should be understood therefrom for modifications will become obvious to one skilled in the art upon reading this disclosure and may be made without departing from the spirit of the invention or scope of the appended claims.

What is claimed:

1. A releasable corner joint connector for coupling hollow structural members, comprising:

a central bridge member;

a first boss extending from one end of said central bridge member and adapted to be longitudinally received in one end of a hollow structural member with a press fit relationship;

a second boss extending from the opposite end of said central bridge member and adapted to be longitudinally received in one end of a hollow structural member with a press fit relationship; and, said central bridge member having at least one area of reduced cross-section to provide flexibility to said first boss and said second boss generally in the plane of said central bridge member.

2. The releasable corner joint connector of claim 1, further comprising:

stop means disposed near the interface of said first boss and said central bridge member for preventing said first boss from being received too far into a hollow structural member; and, stop means disposed near the interface of said second boss and said central bridge member for preventing said second boss from being received too far into a hollow structural member.

3. The releasable joint connector of claim 1, further comprising at least a third boss extending from said central bridge member intermediate said first boss and said second boss and adapted to be longitudinally received in one end of a hollow structural member with a press fit relationship.

4. The releasable corner joint connector of claim 1, wherein:

said central bridge member has a first area of reduced cross-section near the interface of said first boss and said central bridge member; and, said central bridge member has a second area of reduced cross-section near the interface of said second boss and said central bridge member.

5. The releasable corner joint connector of claim 4, wherein:

the first end of said central bridge member from which said first boss extends has a generally T-shaped transverse cross-section; and, the second end of said central bridge member from which said second boss extends has a generally T-shaped transverse cross-section.

6. The releasable corner joint connector of claim 5, wherein:

said first area of reduced cross-section comprises the stem of said T-shaped cross-section of said first end having a location of reduced depth to provide the flexibility to said first boss; and, said second area of reduced cross-section comprises the stem of said T-shaped cross-section of said second end having a location of reduced depth to provide the flexibility to said second boss.

7. The releasable corner joint connector of claim 1, wherein:

said first boss is generally H-shaped in transverse cross-section, the two parallel flanges of the H-shape being each wider than the cord length of the hollow structural member to be connected to said first boss at the locations of contact between each of said flanges and the hollow structural member such that said flanges will be resiliently deflected by the hollow structural member and provide press fit relationship between said flanges and the hollow structural member; and, said second boss is generally H-shaped in transverse cross-section, the two parallel flanges of the H-shape being each wider than the cord length of the hollow structural member to be connected to said second boss at the locations of contact between each of said flanges and the hollow structural member such that said flanges will be resiliently deflected by the hollow structural member and provide the press fit relationship between said flanges and the hollow structural member.

8. The releasable joint connector of claim 1, wherein:

said first boss includes a plurality of longitudinally extending splines protruding outwardly from said first boss to frictionally grip a hollow structural member; and, said second boss includes a plurality of longitudinally extending splines protruding outwardly from said second boss to frictionally grip a hollow structural member.

9. The releasable corner joint connector of claim 5, wherein said central bridge member comprises a generally I-shaped transverse cross-section generally between said first and second areas of reduced cross-section, and the cross flange of said T-shaped cross-section of said first end and the cross flange of said T-shaped cross-section of said second end are both coextensive with the same one of the flanges of the I-shaped transverse cross-section of said central bridge member.

10. The releasable corner joint connector of claim 9, wherein the other one of the flanges of said I-shaped transverse cross-section is generally longitudinally arcuately shaped and joins at its opposite ends to the one of said flanges of said I-shaped cross-section which is coextensive with said flanges of said first and second ends near said first and second areas of reduced cross-section.

11. The releasable corner joint connector of claim 1, wherein said at least one area of reduced cross-section of said central bridge member is intermediately disposed between said first and second bosses.

12. The releasable corner joint connector of claim 11, further comprising means defining a slot in said central bridge member between said first boss and said second boss, at least a part of said slot being open.

13. The releasable corner joint connector of claim 12, wherein said slot extends to either side of said opening generally toward said first and second ends of said central bridge member.

14. The releasable corner joint connector of claim 13, wherein:

said first boss is generally H-shaped in transverse cross-section, the two parallel flanges of the H-shape being each wider than the cord length of the hollow structural member to be connected to said first boss at the locations of contact between each of said flanges and the hollow structural member such that said flanges will be resiliently deflected by the hollow structural member and provide a frictional grip between said flanges and the hollow structural member; and, said second boss in generally H-shaped in transverse cross-section, the two parallel flanges of the H-shape being each wider than the cord length of the hollow structural member to be connected to said second boss at the locations of contact between each of said flanges and the hollow structural member such that said flanges will be resiliently deflected by the hollow structural member and provide a frictional grip between said flanges and the hollow structural member.

15. The releasable corner joint connector of claim 12, wherein:

said first boss includes a plurality of longitudinally extending splines protruding outwardly from said first boss to frictionally grip a hollow structural member; and, said second boss includes a plurality of longitudinally extending splines protruding outwardly from said second boss to frictionally grip a hollow structural member.

16. The releasable corner joint connector of claim 11, wherein said central bridge member has a generally T-shaped transverse cross-section, and the stem of said T-shaped transverse cross-section of said central bridge member has a location of reduced depth defining said at least one area of reduced cross-section.

17. The releasable corner joint connector of claim 1, integrally formed of a plastic material selected from the group consisting of polypropylene, polystyrene, polyvinylidine chloride, and polyvinylidene floride.

* * * * *